US005946751A

United States Patent [19]

DeMay

[11] Patent Number: 5,946,751

[45] Date of Patent: Sep. 7, 1999

[54] APPARATUS AND METHODS FOR RETAINING BEDDING AND METHODS FOR MANUFACTURING SAME

[76] Inventor: Steven E. DeMay, 2154 Sierra Santiago, Bullhead City, Ariz. 86442

[21] Appl. No.: 09/041,570

[22] Filed: Mar. 12, 1998

[51] Int. Cl.[6] ..... A47C 21/02

[52] U.S. Cl. ..... 5/504.1; 5/496; 5/923; 24/72.5

[58] Field of Search ..... 5/496, 498, 504.1, 5/922, 923, 482; 24/72.5

[56] References Cited

U.S. PATENT DOCUMENTS

| | | | |
|---|---|---|---|
| 1,659,519 | 2/1928 | Dilatush | 5/498 |
| 2,188,576 | 1/1940 | Mulloy . | |
| 2,284,778 | 6/1942 | Treiber | 5/498 |
| 2,459,497 | 1/1949 | Calabro | 5/496 |
| 2,490,867 | 12/1949 | Greenhill . | |
| 4,040,133 | 8/1977 | Gilreath | 5/923 |
| 4,222,139 | 9/1980 | Suedberg-Recker et al. | 5/498 |
| 4,301,561 | 11/1981 | McLeod | 5/496 |
| 4,488,323 | 12/1984 | Colburn | 5/496 |
| 4,646,375 | 3/1987 | Parker | 5/498 |
| 4,833,744 | 5/1989 | Correa | 5/496 |
| 4,979,251 | 12/1990 | Lazar | 5/923 |
| 5,005,237 | 4/1991 | Luchonok | 5/688 |
| 5,027,456 | 7/1991 | Wadsworth | 5/494 |
| 5,092,010 | 3/1992 | Wong | 5/496 |
| 5,205,003 | 4/1993 | Green | 5/923 |
| 5,208,926 | 5/1993 | Stackhouse | 5/496 |
| 5,327,595 | 7/1994 | Allen | 5/922 |
| 5,621,931 | 4/1997 | Hamilton | 5/923 |
| 5,794,285 | 8/1998 | Burch | 5/496 |

*Primary Examiner*—Alex Grosz
*Attorney, Agent, or Firm*—Wallenstein & Wagner, Ltd.

[57] ABSTRACT

Apparatus is provided for retaining a bedding article of a bed. In one embodiment, the apparatus comprises a base and a skirt extending from the base that is adapted to be disposed below a structural member. A plurality of first fasteners are attached to the skirt, each first fastener adapted to removably engage with a corresponding one of a plurality of second fasteners attached to the bedding article by adhesive means. A plurality of tabs are attached to sites on the skirt, wherein an end of each tab is free to rotate with respect to the attachment site of the tab. Each first fastener is secured to a corresponding one of the tabs. In another embodiment, the apparatus comprises at least one first side flap having a first fastener and adapted to be folded around a portion of a first side wall of the mattress, at least one second side flap having a second fastener and adapted to be folded around a portion of a second side wall of the mattress, and at least one end flap having at least one end fastener and adapted to be folded around a portion of an end wall of the mattress. The first and second fasteners are adapted to removably engage with the end fastener at a location adjacent a first horizontal surface of the mattress. Methods for assembling and manufacturing a bedding retention apparatus are also provided.

16 Claims, 6 Drawing Sheets

APPARATUS AND METHODS FOR RETAINING BEDDING AND METHODS FOR MANUFACTURING SAME

TECHNICAL FIELD

The present invention relates to apparatus and methods for retaining or enclosing bedding articles as well as methods for manufacturing the apparatus.

BACKGROUND OF THE INVENTION

A practicable solution to the widely acknowledged problem of the tendency of sheets, blankets and the like to loosen from a mattress, come undone and fall onto the floor during occupancy of a bed has to date not been given sufficient consideration by manufacturers of bed components. Past approaches have included, for instance, the provision of complex, cumbersome and constrictive apparatus such as leather straps and harnesses, bed boards, nuts and bolts, belts and buckles, large buttons and snaps, zippers, spring-biased clamps, full-length sheathing, flaps weighted down with elongated ribs, and rigid bed corner fixtures. It is thus evident that a need remains for provision of an unobtrusive means by which bedding materials can be retained and prevented from coming loose during use of the bedding materials and occupancy of the bed. There exists a further need for an apparatus which retains bedding materials and prevents the materials from coming into disarray while folding or retracting the materials at one end of the bed. The invention disclosed herein solves these and related problems.

SUMMARY OF THE INVENTION

Apparatus is provided for retaining a bedding article of a bed. In one embodiment, the apparatus comprises a base and a skirt extending from the base that is adapted to be disposed below a structural member. A plurality of first fasteners are attached to the skirt, each first fastener adapted to removably engage with a corresponding one of a plurality of second fasteners attached to the bedding article by adhesive means. A plurality of tabs are attached to sites on the skirt, wherein an end of each tab is free to rotate with respect to the attachment site of the tab. Each first fastener is secured to a corresponding one of the tabs. Each first or second fastener includes a base element having a base element area and a fastening element having a fastening element area less than the base element area, wherein the fastening element is centrally disposed on the base element. The base is adapted to be disposed on the structural member, and the skirt depends from the base and is adapted to be disposed circumjacent to at least an end portion of the structural member. The skirt has a first side region adapted to be disposed adjacent to a first side wall of the structural member, a second side region adapted to be disposed adjacent to a second side wall of the structural member, and an end region adapted to be disposed adjacent to an end wall of the structural member.

In another embodiment, an apparatus is provided for retaining one or more bedding articles of a mattress. The apparatus comprises at least one first side flap having a first fastener and adapted to be folded around a portion of a first side wall of the mattress, at least one second side flap having a second fastener and adapted to be folded around a portion of a second side wall of the mattress, and at least one end flap having at least one end fastener and adapted to be folded around a portion of an end wall of the mattress. The first and second fasteners are adapted to removably engage with the end fastener at a location adjacent a first horizontal surface of the mattress. Means are provided for securing at least one of the first side flap, second side flap and end flap at a location adjacent a second horizontal surface of the mattress. Each side flap is attached to a base and the end flap attached to each side flap, or each side flap is attached to the end flap and the end flap attached to a base. The first side flap may have a plurality of first fasteners, the second side flap may have a plurality of second fasteners and the end flap may have first and second sets of end fasteners, wherein each first fastener is adapted to removably engage with a corresponding one of the first set of end fasteners and each second fastener is adapted to removably engage with a corresponding one of the second set of end fasteners. A plurality of first side flaps, second side flaps and end flaps may be provided.

In another embodiment, apparatus is provided for retaining bedding articles of a bed that includes an upper structural member having first and second upper side walls and an upper end wall, and a lower structural member having first and second lower side walls and a lower end wall. The apparatus comprises a base adapted to be disposed between the upper and lower structural members, a skirt extending from the base, and a plurality of base fasteners attached to the skirt and adapted to removably engage with a plurality of corresponding bedding fasteners attached to a bedding article. First and second side flaps are secured to the base, each flap having a side fastener, wherein the first side flap is adapted to circumscribe at least a portion of the first upper side wall and the second flap is adapted to circumscribe at least a portion of the second upper side wall. An end flap is secured to the first and second side flaps and has at least one end fastener, and is adapted to circumscribe at least a portion of the upper end wall. The side fasteners of the first and second side flaps are adapted to removably engage with the end fastener at a location adjacent a horizontal surface of the upper structural member.

A method is provided for assembling a bedding retention apparatus comprising a number of components as described above. A base is disposed onto a mattress support with a skirt depending from the base and a plurality of base fasteners attached to the skirt. A mattress is disposed onto the base and mattress support. First and second side flaps having side fasteners and attached to the base or to an end flap are wrapped around side walls of the mattress and disposed adjacent to a horizontal surface of the mattress. The end flap having end fasteners is wrapped around an end wall of the mattress and the end fasteners are mated with corresponding side fasteners.

A method is also provided for manufacturing a bedding retention apparatus. A base is provided with a first side edge, a second side edge and an end edge. A skirt is formed having a first side panel, a second side panel and an end panel, such that the first side panel depends from the first side edge, the second side panel depends from the second side edge and the end panel depends from the end edge. A plurality of base fasteners are attached to the panels of the skirt such as by stitching. A bedding article is also provided. A plurality of bedding fasteners are secured to the bedding article, such as by stitching or adhesive means, to mate with corresponding base fasteners. A first side flap, a second side flap and an end flap are provided. The side flaps are secured to the base and the end flap is secured to the side flaps. One or more end fasteners are secured to the end flap. One or more side fasteners are secured to the side flaps to mate with corresponding end fasteners to retain one or more bedding articles installed on a mattress.

Other features and advantages of the invention will be apparent from the following specification taken in conjunction with the following drawings.

DETAILED DESCRIPTION OF THE INVENTION INCLUDING PREFERRED EMBODIMENTS

Figure 1:
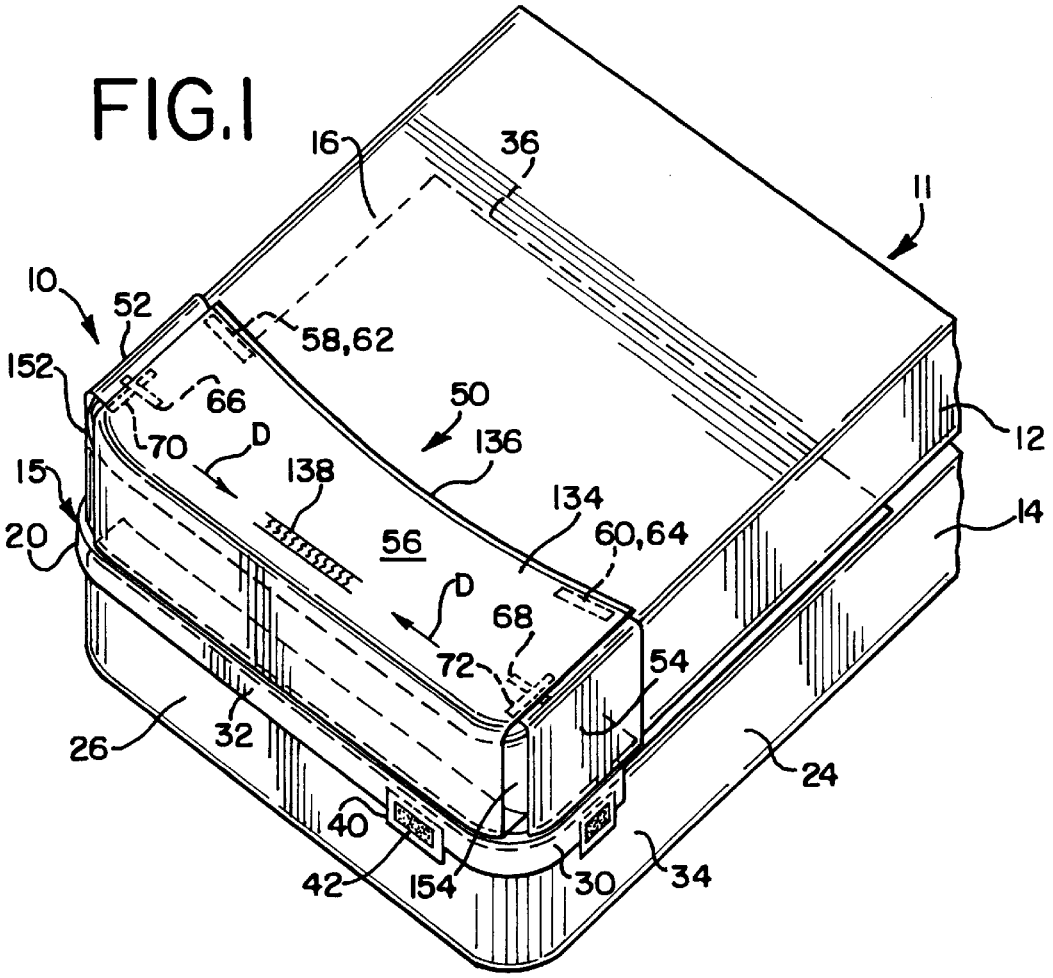
FIG. 1 is a perspective view of one embodiment according to the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. The following description details the aspects of the invention including both apparatus and methods.

FIG. 1 illustrates in perspective a bedding retention apparatus 10 according to the present invention. The apparatus 10 is particularly useful in conjunction with a conventional bed 11 arranged to include a mattress or some other type of upper structural member 12 supported on a box spring or other type of lower structural member 14, with the additional possibility of a bed frame (not shown) providing lowermost support.

Figure 2:
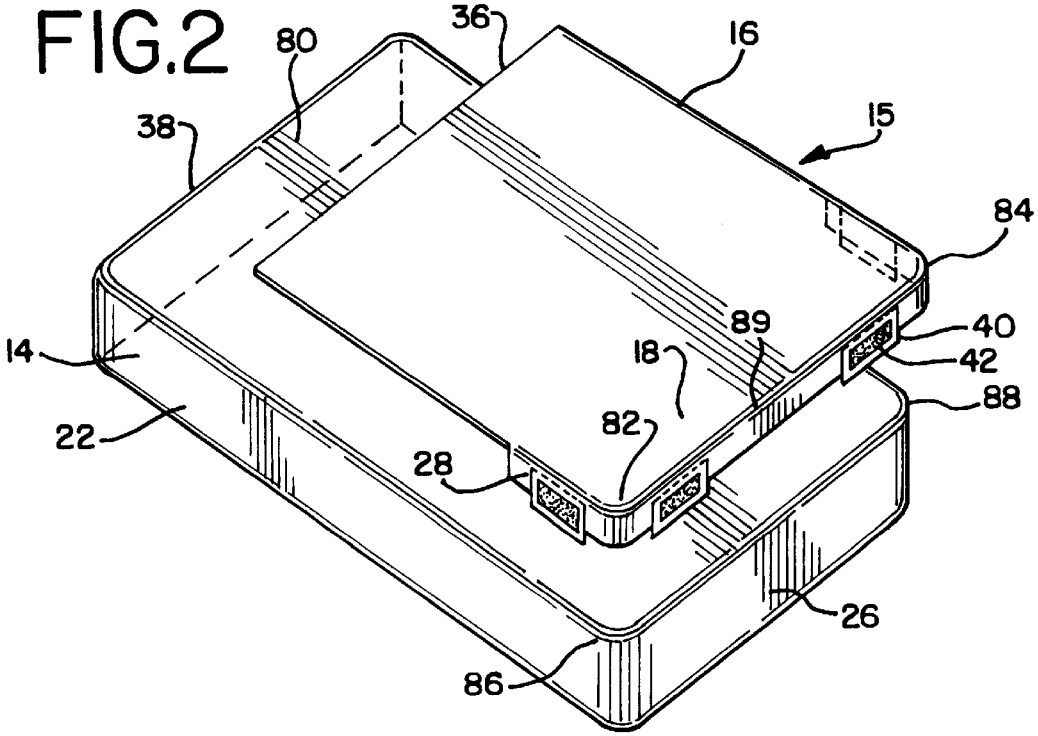
FIG. 2 is a perspective view of a bedding retainer according to the present invention.

One aspect of the present invention is a bedding retainer 15 which is shown in full perspective in FIG. 2. The bedding retainer 15 includes a base 16, the major portion of which is shown by phantom lines in FIG. 1. The base 16 is preferably a flexible sheet constructed of a suitable textile or linen material. Depending from the base 16 near one end region 18 is a skirt 20. The skirt 20 is adapted to conform or fit in adjacent relation to a first side wall 22 (FIG. 2), a second side wall 24 and an end wall 26 of the box spring 14. The skirt 20 includes a first side panel or region 28 (FIG. 2), a second side panel or region 30 and an end panel or region 32. The first and second side panels 28,30 may be approximately 20 inches in length and 2–4 inches in height. Preferably, the panels 28,30,32 are joined such that the skirt 20 constitutes a continuous band of sheet material which wraps around one end 34 of the box spring 14. The box spring end 34 preferably corresponds to the "foot" of the bed 11. The length of the base 16 is such that a leading end 36 of the base 16 terminates at a line short of an end or "head" 38 of the bed 11. For example, the length may be approximately 50 inches. A plurality of tabs 40, constructed of either a flexible or rigid material, are sewn or otherwise attached to the skirt 20 at various locations. Each tab 40 is provided with a fastener 42. The fasteners 42 are to be mated with complementary fasteners attached to a bedding article such as a blanket, quilt or bed comforter (not shown). The fastener 42 is suitably the hook-and-loop type such as that marketed under the VELCRO trademark, and may be approximately 6 inches in length.

Another aspect of the present invention illustrated in FIG. 1 is a bedding enclosure 50. The bedding enclosure 50 includes a first side flap 52, a second side flap 54, and an end flap 56. The flaps 52,54,56 may be constructed as continuous sheets of textile or linen material, or alternatively may have a netted, webbed or other open structure of varying elasticity. The flaps 52,54,56 are sewn or otherwise attached at a location below the mattress 12, and attached to each other above the mattress 12 through the use of fasteners 58,60, 62,64,66,68,70,72, in a manner described below.

Figure 3:
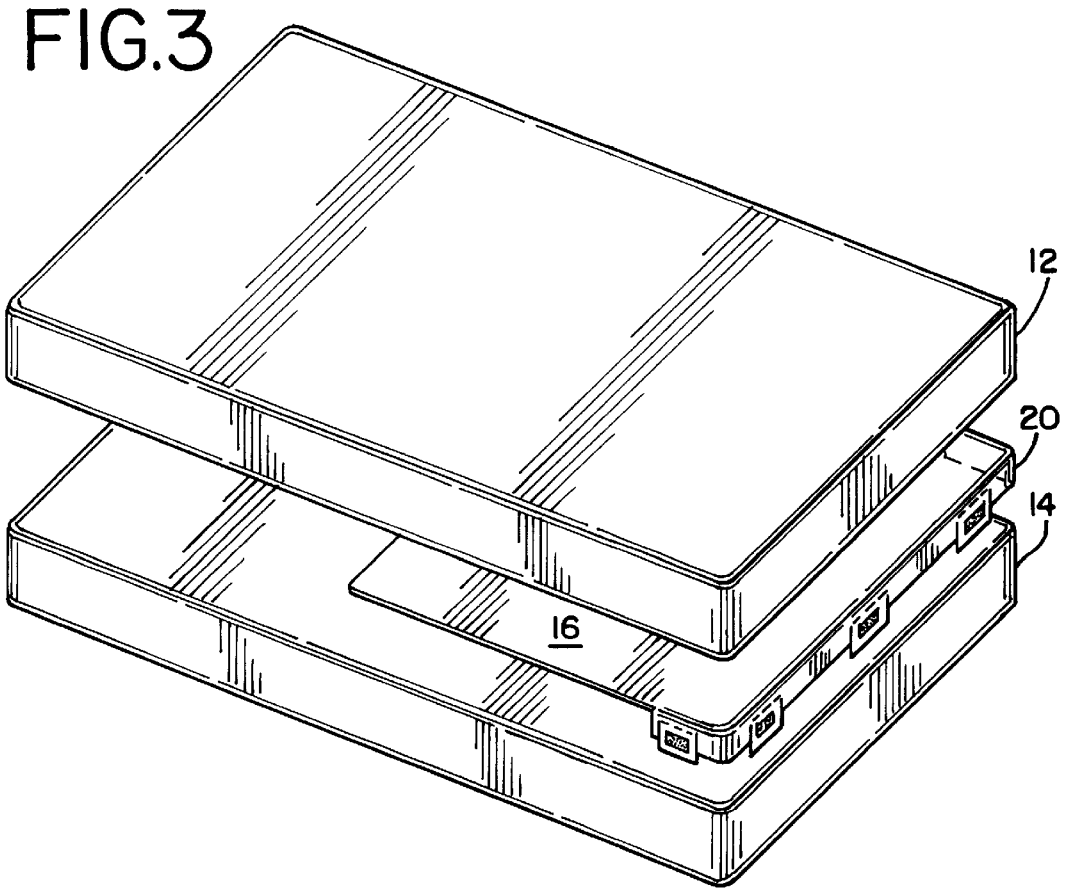
FIG. 3 is another perspective view of the embodiment shown in FIG. 2.
Figure 4:
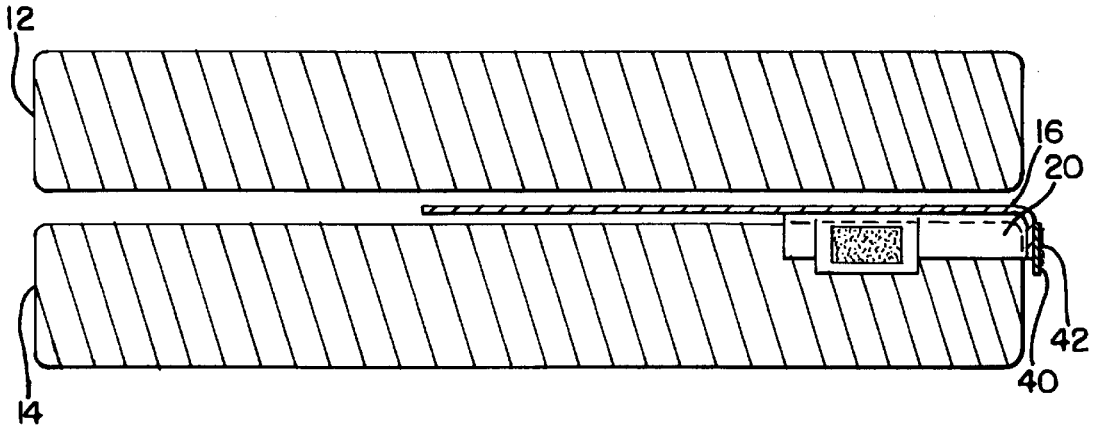
FIG. 4 is a cross-sectional side view of the embodiment shown in FIG. 3.

As shown in FIG. 2, the base 16 is installed in the bed 11 by removing the mattress 12 and placing the base 16 onto the top surface 80 of the box spring 14. The base 16 is then grasped, for instance, at the leading end 36 and pulled toward the head 38 of the bed 1 I until the skirt 20 abuts the end wall 26 of the box spring 14, thus creating a snug fit among respective corners 82,84 and 86,88 of the skirt 20 and box spring 14. To further improve the conformity or fit of the end region 18 of the bedding retainer 15 with the foot of the bed 11, the bedding retainer 15 may include flexible cording or piping (not shown) along a juncture or boundary 89 defined between the base 16 and the skirt 20. As shown in FIGS. 3 and 4, the mattress 12 is then placed on top of both the base 16 and the box spring 14. The weight of the mattress 12 is sufficient to maintain the proper positions of the base 16 and skirt 20 between the mattress 12 and box spring 14 and hence prevent sliding movement. The additional weight of the occupant or occupants of the bed 11 will further ensure the proper positions of the base 16 and skirt 20. If even greater tightness or integrity in the installation of the bedding retainer 15 is desired, one or more elastic belts (not shown) or equivalent components may be attached—such as by clips or direct stitching—at or near the leading end 36 and removably attached to the box spring 14 or bed frame to develop tension throughout the expanse of the base 16.

Figure 5:
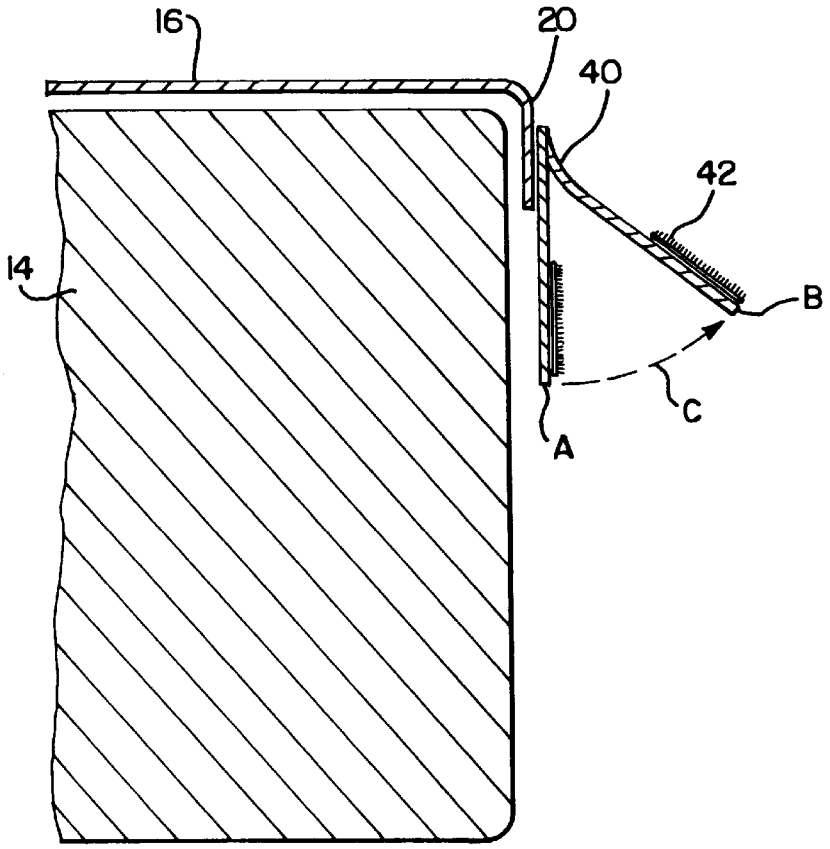
FIG. 5 is a detailed cross-sectional side view of an end of the embodiment shown in FIG. 4.
Figure 6:
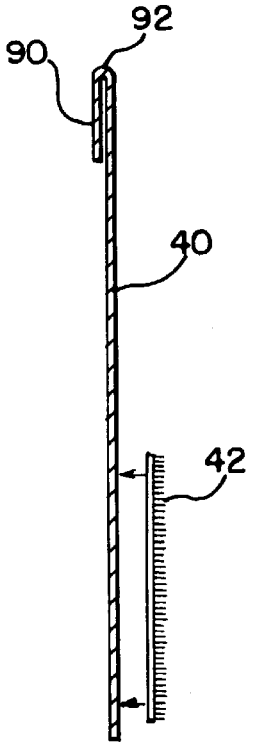
FIG. 6 is a side elevational view of one aspect of the present invention.

FIGS. 5–8 illustrate in detail the tabs 40 and fasteners 42 employed in the present invention. Each tab 40 is secured such as by sewing the tab 40 directly to the skirt 20. Each fastener 42 is similarly secured to each corresponding tab 40. As FIG. 5 illustrates, each tab 40 is provided with a significant degree of freedom. That is, each tab 40 may swing in the direction indicated by arrow C from position A, beyond position B, and to a position approximately 180 degrees from position A. Such a configuration affords flexibility in the movement of a bed comforter attached to the fasteners 42. For instance, if the tabs 40 provided each have a height of 3–4 inches the comforter will have a 6- to 8-inch range of vertical travel. The comforter thus may be retained without undue confinement of the bed occupant or occupants. As shown in FIG. 6, the attachment site of the tab 40 to the skirt 20 may be reinforced by folding an upper portion 90 of the tab 40 to create a double-layered region 92 through which stitching or other means is applied to the skirt 20. Alternatively, instead of employing the double-layered region 92 as a reinforcement, the upper portion 90 may be folded over as shown for use as a hem to conceal stitching within the double-layered region 92.

The fasteners 42 are intended to provide attachment points for a bed comforter or other bedding article (not shown) in order to maintain the comforter in its proper position on the bed 11 during occupancy. For this purpose, hook-and-loop fasteners have been found suitable. Hence, if the fasteners 42 are provided as a patch or array of hooks, corresponding fasteners having an arrangement of loops are provided with the comforter to mate with the fasteners 42. With respect to the manufacturing and distribution of embodiments of the present invention, the corresponding fasteners of the comforter may be located on and directly attached to the comforter by the manufacturer.

Alternatively, the fasteners 94 of the type shown in FIG. 7 may be provided to the end user as separate components for later installation by the end user to the end user's choice of comforter. The fastener 94 includes an operative fastening element 96 that comprises either hooks or loops and is centrally located on a support pad 98. Preferably, a pressure sensitive adhesive layer or film (not shown), having a known composition and properties compatible with a textile surface, is applied to a rear surface of the support pad 98 and is initially protected by a backing strip (not shown). Once the end user has installed the base 16 on the box spring 14 with the skirt 20 in its proper position and has positioned the mattress 12 on the base 16 and box spring 14, the end user then places the comforter in the desired position to determine suitable locations for the fasteners 94 on the comforter. The end user then removes the backing strips of the fasteners 94 and secures each fastener 94 to the comforter. In order to increase the effective service life of the fasteners 94, the operative fastening element 96 of each fastener 94 is centrally located on the support pad 98 such that each outer edge 101 of the operative fastening element 96 is offset approximately ¼ to ½ inch from each corresponding outer edge 103 of the support pad 98. This offset configuration centrally distributes the stresses observed by the adhesive layer as a consequence of repeated cycling (i.e., attachment and removal) of the comforter at the fastening locations. Thus, any sites of adhesive failure which develop as a result of cyclical use of the fastener 94 will most likely occur within a central portion of the adhesive layer directly behind the operative fastening element 96, rather than within perimetral areas 105 defined between the outer edges 101 and 103. The risk that such failure sites will propagate to the outer edge 103 of the fastener 94, and promote a total failure of the adhesive layer, is thereby reduced significantly.

Figure 7:
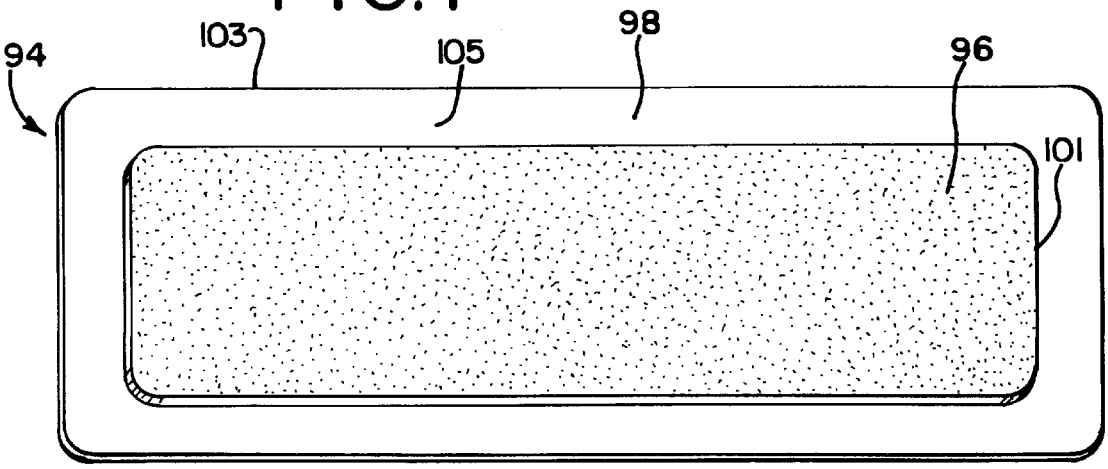
FIG. 7 is a top view of another aspect of the present invention.

The fasteners 42 of the skirt 20 may likewise be provided with the configuration of the fasteners 94 illustrated in FIG. 7 to ease the cyclical stresses observed by the stitching or other means for securing the fasteners 42 to the tabs 40.

Figure 8:
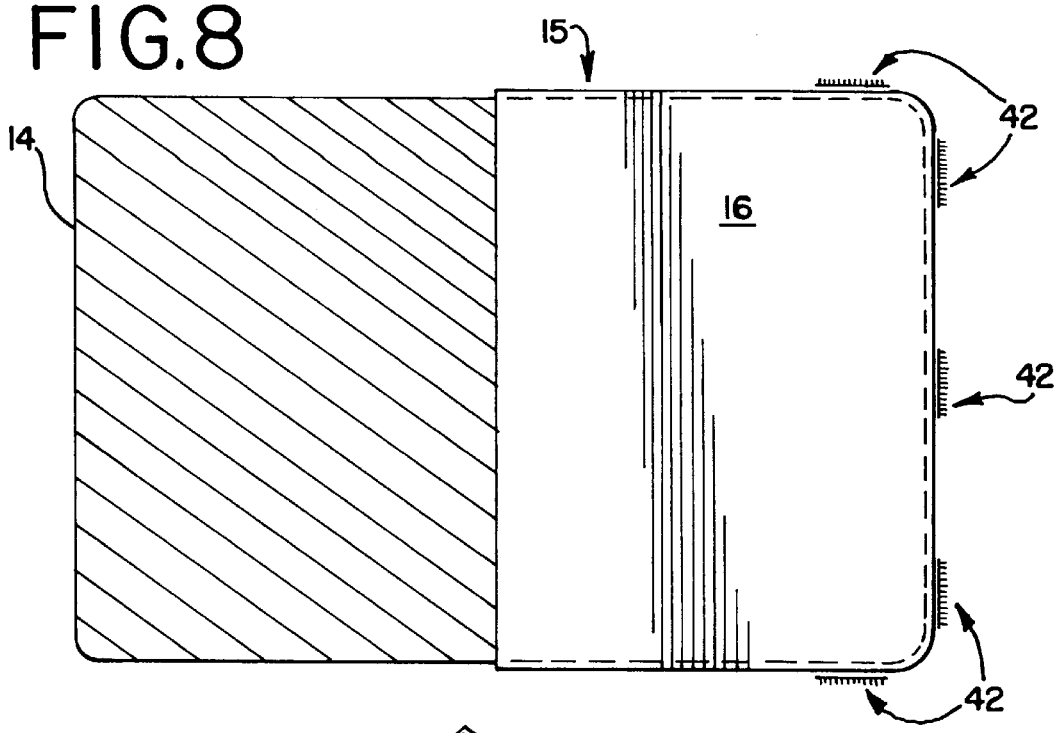
FIG. 8 is a top view of the embodiment shown in FIG. 2.
Figure 9:
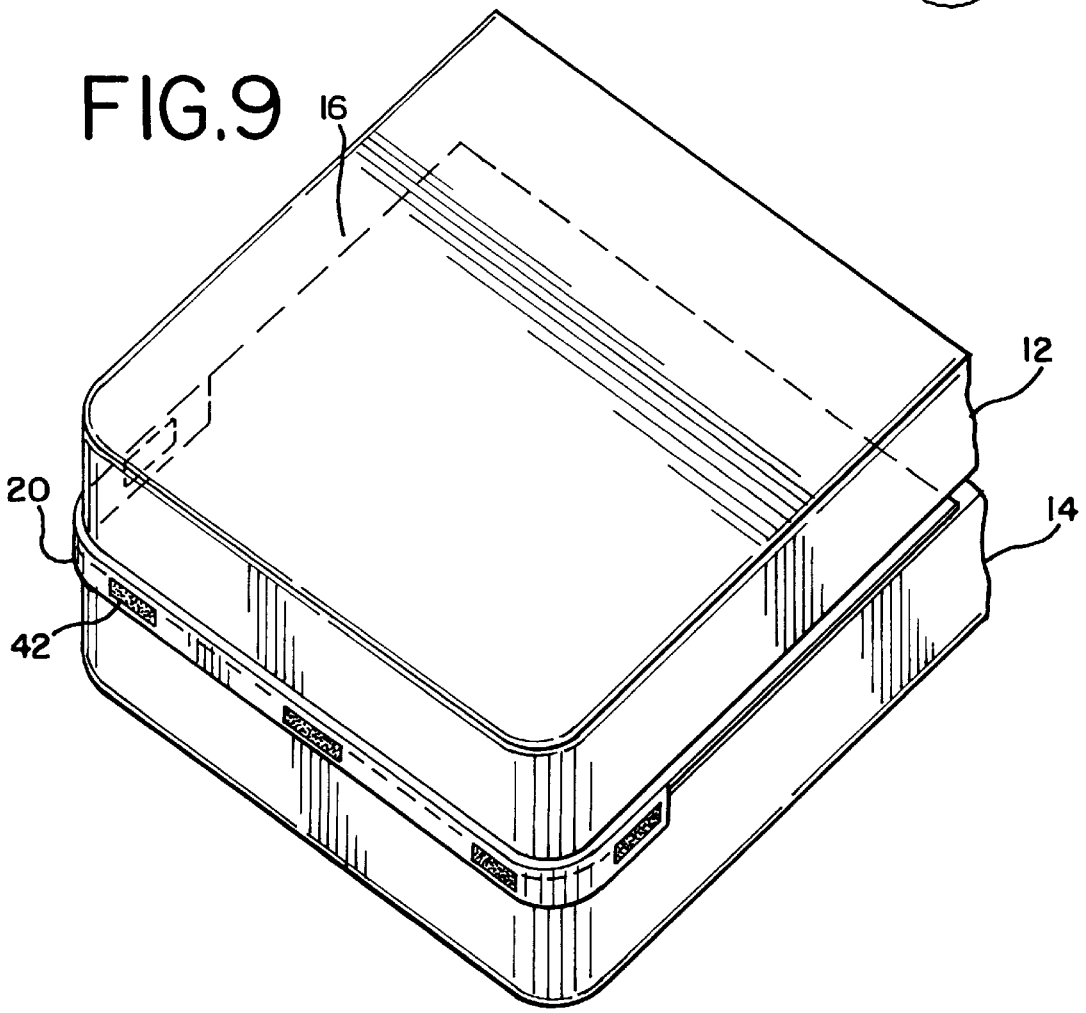
FIG. 9 is a perspective view of another embodiment according to the present invention.

As shown in FIG. 8, the fasteners 42 of the skirt 20 (and thus the fasteners 94 of the comforter as well) are provided at locations within the vicinity of the foot of the bed 11. This arrangement ensures that the comforter is effectively restrained during use of the bed 11 while at the same time affords flexibility in the movement and folding of the comforter at other regions of the bed 11. Four or five fasteners 42 have been found suitable for the practice of the invention.

Where it is desired to further limit the degree of movement of the comforter during occupancy of the bed 11, the fasteners 42 alternatively may be secured directly to the skirt 20 as shown in FIG. 9, thereby eliminating use of the tabs 40 and their attendant functionality. As a further alternative, the fasteners 42 and/or the tabs 40 may be attached to a dust ruffle.

It will be understood that an end user who occupies only a mattress 12 disposed directly on the floor without a box spring 14 or other lower structural member may nevertheless benefit from use of the bedding retainer 15. In such a case, the end user would employ the bedding retainer 15 in an inverted manner with little or no modification. That is, the base 16 may be turned over and disposed between the mattress 12 and the floor, and fasteners 42 may be provided as shown in FIGS. 1 or 9.

Figure 10:
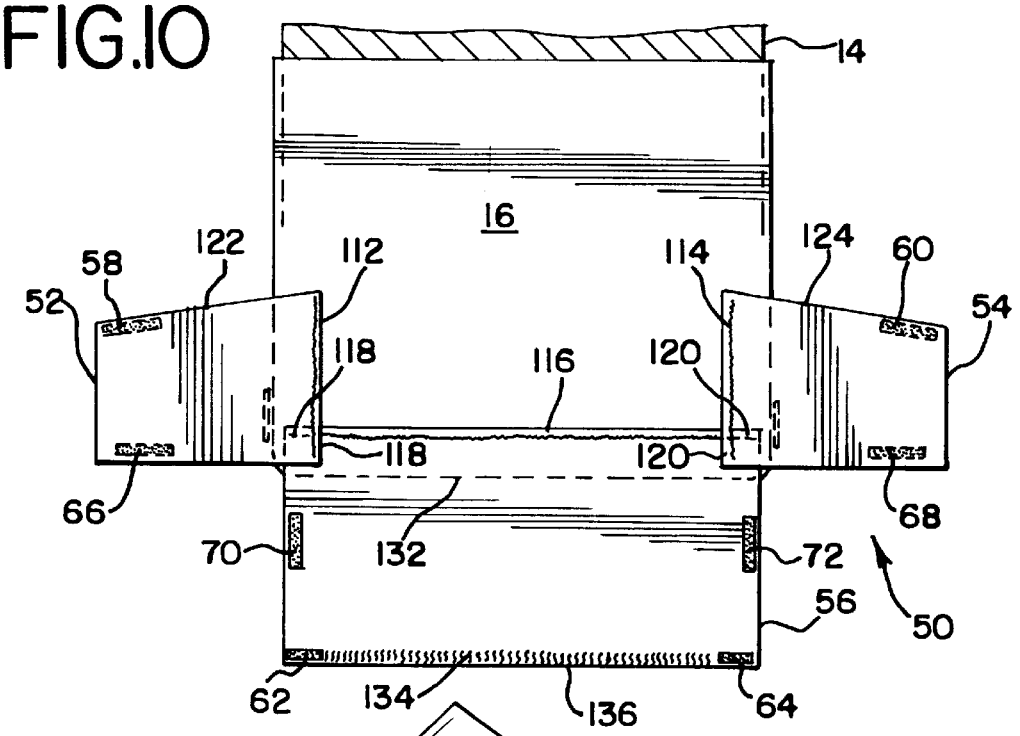
FIG. 10 is a top view of another embodiment of the present invention.
Figure 11:
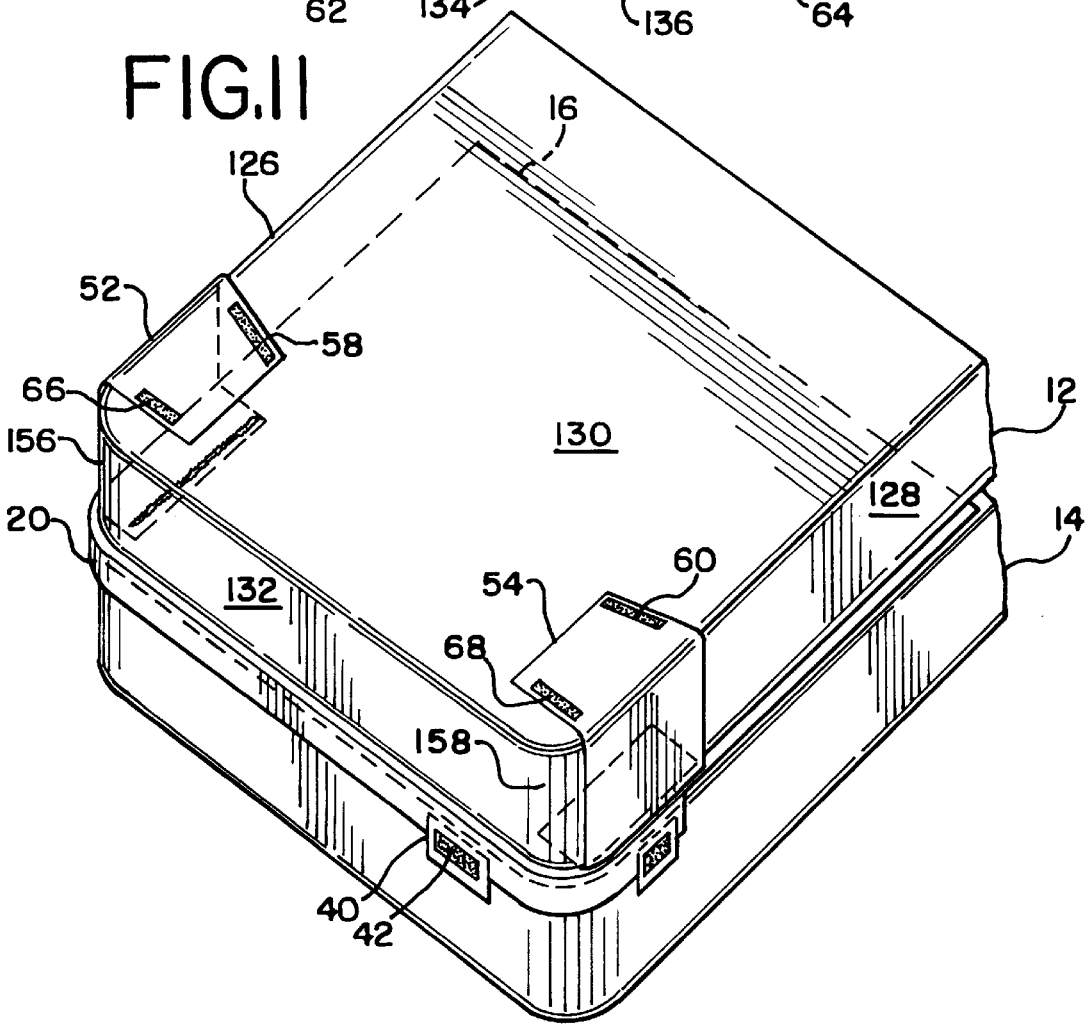
FIG. 11 is a perspective view of another embodiment of the present invention.
Figure 12:
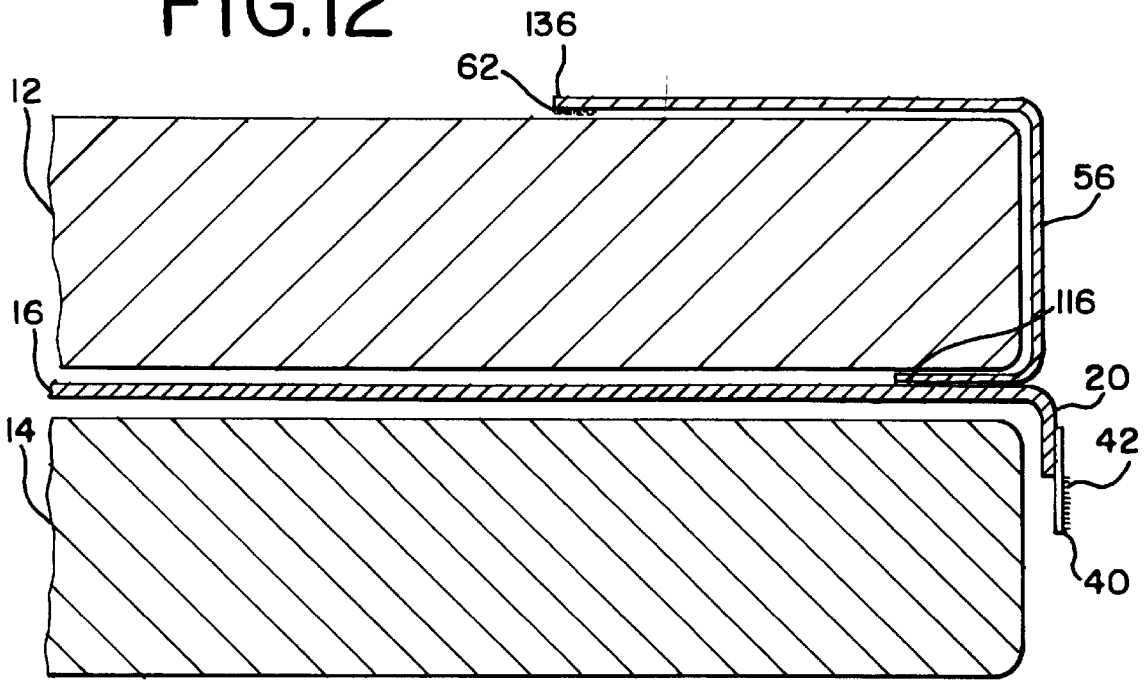
FIG. 12 is a cross-sectional side view of embodiment shown in FIG. 1; and, FIG. 13 is another cross-sectional side view of embodiment shown in FIG. 1.

As an additional or separate aspect of the present invention, the construction and assembly of the bedding enclosure 50 is illustrated in FIGS. 10–12. FIG. 10 illustrates the preferable method for securing the bedding enclosure 50 below the mattress 12. The first side flap 52 is attached to the base 16 along a stitch line 112, the second side flap 54 is attached to the base 16 along a stitch line 114, and the end flap 56 is attached to the base 16 along a stitch line 116. The first side flap 52 and the end flap 56 are attached to each other along separate stitch lines 118, and the second side flap 54 and the end flap 56 are attached to each other along separate stitch lines 120. The fact that the stitch lines 118,120 are separate from the stitch lines 112,114,116 affords greater flexibility in the assembly and motion of the bedding enclosure 50 as well as in the accommodation of the bedding enclosure 50 to a variety of mattress sizes and weights. At least one respective edge 122,124 of the first and second side flaps 52,54 may be tapered to increase freedom of movement of the occupant or occupants of the bed 11. The first side flap 52 has a fastener 58 (shown in phantom in FIG. 10) secured to an intended top surface of the first flap 52; likewise, the second side flap 54 has a fastener 60. It will be noted that additional side flaps or a plurality of separate end flaps may be provided if desired.

Once the base 16 has been positioned onto the box spring 14 as shown in FIG. 10, with a conventional dust ruffle (not shown) as needed, the mattress 12 is placed onto the box spring 14 with the base 16 situated therebetween. The bed 11 is then made by the end user; that is, a mattress liner or pad, and one or more sheets and blankets (not shown) are installed. As shown in FIG. 11, the first and second side flaps 42,54 are gently pulled and brought around first and second side walls 126,128 of the mattress 12 to rest upon a top surface 130 of the mattress 12, such that the fasteners 58,60 are operatively exposed. For purposes of clarity, the end flap 56 is not shown in FIG. 11. As shown in FIG. 1, the end flap 56 is then gently pulled and brought around an end wall 132 of the mattress 12 and the fasteners 62,64 are respectively mated with the fasteners 58,60 on the top surface 130 to enclose a portion of the sheets, blankets, etc. of the bed 11. It will be appreciated that the multi-flap design disclosed herein greatly facilitates assembly and disassembly of the bedding enclosure 50.

An elastic band 134 should be provided to ensure a tighter fit and neater appearance of the bedding enclosure 50, to provide flexibility in the movement of the end flap 56, and to avoid undue restraint on the feet of occupants of the bed 11. The elastic band 134 preferably is provided proximate to a leading edge 136 of the end flap 56. The elastic band 134 itself is small and light so as to be unobtrusive to the occupant or occupants of the bed 11. In order to assist the assembled bedding enclosure 50 in conforming to the shape of the enclosed portion of the occupied bed 11, the length of the leading edge 136 should be approximately 6 inches greater than the length of an opposite edge 142 near the stitch line 116, when the elastic band 134 is fully stretched. In the stretched state, side edges 144,146 of the end flap 56 taper outward from the opposite edge 142 to the leading edge 136.

In addition, in order to better accommodate a wide range of thicknesses and resiliencies of differing mattress models as well as to further enhance the fit and appearance of the bedding enclosure 50, the first and second side flaps 52,54 and the end flap 56 may alternatively be provided with extra fasteners as shown in FIGS. 1,10 and 11. As an example, the first and second side flaps 52,54 may be provided with fasteners 66,68 respectively spaced at a distance from the fasteners 58,60, and the end flap 56 may be provided with fasteners 70,72 respectively spaced at a distance between the edge 134 and the stitch line 116. Thus, when the end flap 56 is brought around the end wall 132 and the fasteners 62,64 are mated to the fasteners 58,60, the fasteners 70,72 will respectively attach to the fasteners 66,68. In the embodiment exemplified in FIGS. 1,10 and 1, the paired fasteners 66,70 and 68,72 each form a cross arrangement to provide flexible accommodation of a variety of longitudinal and transverse dimensions of the mattress 12, to serve as additional holding points for the bedding enclosure 50, and to develop more tension throughout the bedding enclosure 50. As the bedding enclosure 50 is assembled, the fasteners 70,72 of the end flap 56 essentially secure themselves onto the corresponding fasteners 66,68 as dictated by mattress height or thickness. As shown in FIG. 1, an additional short (e.g., approximately 12 inches) elastic strip 138 may be disposed on the end flap 56 between the fasteners 70,72 to further improve fit and appearance by creating minimal tension in the directions shown by arrows D. The elastic strip 138 is small and light so as to be unobtrusive to the occupant or occupants of the bed 11.

As also shown in FIG. 1, it is preferable that the flaps 52,54,56 be sized or cut such that the assembled bedding enclosure 50 has open areas or gaps 152,154 at the corners 156,158 (FIG. 11) of the mattress 12. This design is provided for purposes of flexibility, fit and accommodation as described above. However, the bedding enclosure 50 may be modified so as to cover the corners 156,158 if desired.

Figure 13:
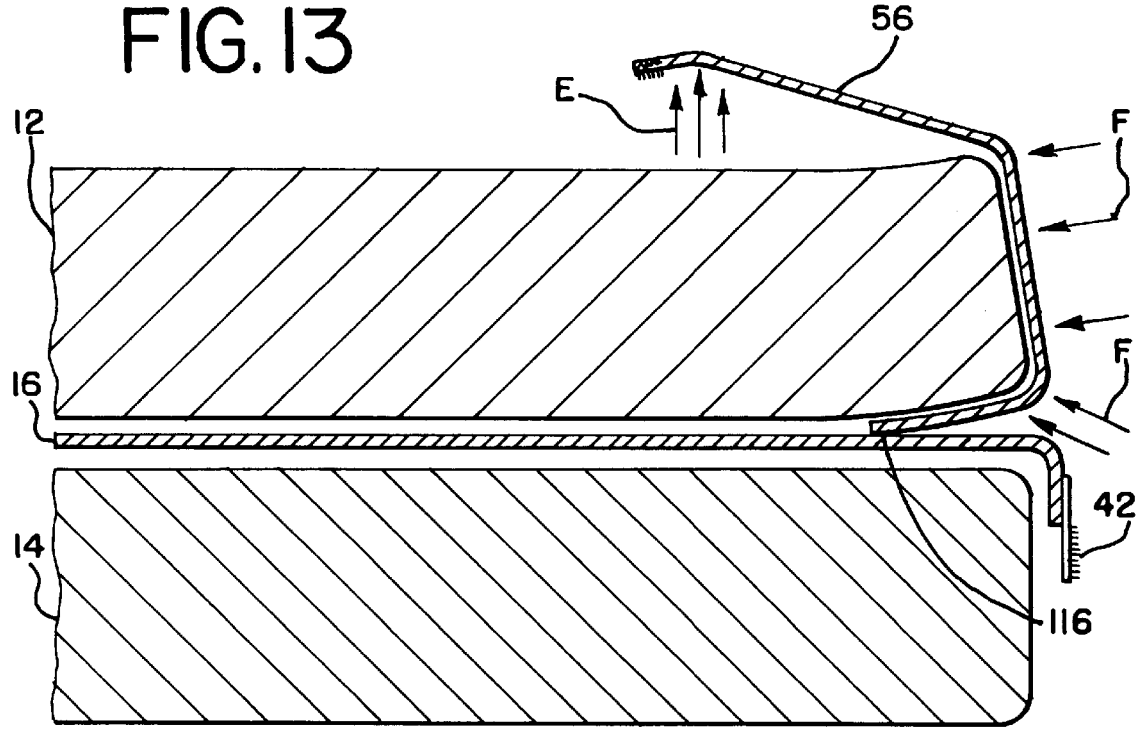

An understanding of the retaining function of the bedding enclosure 50 may be derived by referring to FIG. 13, which depicts a cross-sectional view of the mattress 12, the box spring 14, the base 16, and the end flap 56 when the bed 11 is occupied. Movement of the occupant or occupants will impart a predominantly upward or vertical force against the end flap 56 represented by arrows E. It will be appreciated that the lateral and vertical forces will also be imparted against the first and second side flaps 52,54, which are not shown in FIG. 13. Such movement will produce tension in the material of the end flap 56 (as well as that of the first and second side flaps 52,54) and reactive pinching forces imparted against the enclosed bedding and the mattress 12 in directions indicated, for example, by arrows F. The pinching forces are especially acute at upper and lower end corners of the mattress 12. These reactions are due at least in part to the configuration of the flaps 52,54,56, the elastic properties of the elastic band 134, and the anchoring of the bedding enclosure 50 to the base 16 at the stitch line 116. Consequently, the more the occupant or occupants attempt to pull the bedding retained within the bedding enclosure 50 from between the mattress 12 and box spring 14, the more the holding or locking power of the bedding enclosure 50 increases. A depth of the stitch line 116 in the range of 3–6 inches from the boundary 89 (FIG. 2) has been found optimal to the operation and function of the present invention.

It will be noted the present invention does not require that the bedding retainer 15 and the bedding enclosure 50 be removed from the bed 11 in a case where use of either aspect of the apparatus 10 is not desired. If, for instance, retention of the comforter is not desired, the end user may be provided with additional individual fasteners with smooth, low-friction backing surfaces. The additional fasteners would be mated with the fasteners 42 of the skirt 20 and/or fasteners 94 of the comforter to conceal the hooks and loops and prevent engagement thereof. With respect to the bedding enclosure 50, the flaps 52,54,56 may be tucked underneath the mattress 12 along with the other conventional bedding elements such as sheets and blankets. It will also be apparent that use of the bedding retainer 15 or the bedding enclosure 50, alone or in combination, does not alter or interfere with the end user's normal bed-making routine.

It will be understood that the bedding enclosure 50 may be used without a box spring 14 as in the case of the bedding retainer 15, so long as there is some means by which to secure the flaps 52,54,56 to the underside of the mattress 12. For example, the flaps 52,54,56 may be secured to a rigid or flexible base structure disposed beneath the mattress 12 such as the base 16. It will also be understood that the bedding enclosure 50 may be operably provided by substituting fasteners such as those shown in FIG. 1 for either the stitch lines 118,120 or 112,114 or all of them. In the case where all fasteners 112,114,118,120 are eliminated, the bedding enclosure 50 is free to operate independently from the base 16. Additionally, a continuous sleeve may be substituted for the tripartite flap structure of the bedding enclosure 50 and sewn either to a base portion or to the comforter.

It will be understood as well that the bedding retainer 15 and the bedding enclosure 50 may be further modified without undue experimentation to provide utility in various manners. For one example, either bedding retainer 15 or the bedding enclosure 50, or both, may be provided at either the foot (box spring end 34) or the head 38 of the bed 11, or both, according to the needs of the end user. For another example, the bedding retainer 15 and the bedding enclosure 50 are operable in conjunction with a waterbed, which typically is disposed in a rigid box-like frame. As with many of the flexible components of the waterbed, many of the components of the present invention may have a polyvinyl chloride ("PVC") composition as appropriate.

While the specific embodiments have been illustrated and described, numerous additional modifications come to mind without significantly departing from the broad aspects of the invention, and the scope of protection is only limited by the scope of the accompanying Claims.

What I claim is:

1. For a bed comprising a mattress and a box spring, an apparatus for retaining a bedding article on the bed, the bed having a width, the apparatus comprising:

a base adapted to be disposed between the mattress and the box spring, the base having a width substantially equal to the width of the bed and a length sufficient to maintain the proper position of the base between the mattress and the box spring;

a flexible skirt extending from the base and adapted to be disposed below the mattress, wherein the skirt is adapted to be disposed circumjacent to at least an end portion and side portions of the bed;

a plurality of tabs each attached to sites on the skirt, wherein an end of each tab is free to displace angularly with respect to the attachment site of the tab; and a plurality of first fasteners attached to respective ones of the tabs, each first fastener adapted to removably engage with a corresponding one of a plurality of second fasteners attached to the bedding article.

2. Apparatus for retaining one or more bedding articles of a mattress comprising:

a first side flap having a first fastener and adapted to be folded around a portion of a first side wall of the mattress, a second side flap having a second fastener and adapted to be folded around a portion of a second side wall of the mattress;

an end flap having an end fastener and adapted to be folded around a portion of an end wall of the mattress, wherein the first and second fasteners are adapted to removably engage with the end fastener at a location adjacent to a first horizontal surface of the mattress; and, means for securing at least one of the first side flap, second side flap and end flap at a location adjacent a second horizontal surface of the mattress.

3. Apparatus of claim 2 wherein each side flap is attached to a base and the end flap is attached to each side flap.

4. Apparatus of claim 2 wherein each side flap is attached to the end flap and the end flap is attached to a base.

5. Apparatus of claim 2 wherein the first side flap has a plurality of first fasteners, the second side flap has a plurality of second fasteners and the end flap has first and second sets of end fasteners, wherein each first fastener is adapted to removably engage with a corresponding one of the first set of end fasteners and each second fastener is adapted to removably engage with a corresponding one of the second set of end fasteners.

6. Apparatus of claim 2 including a plurality of first side flaps and a plurality of second side flaps.

7. Apparatus of claim 2 including a plurality of end flaps.

8. Apparatus of claim 2 wherein the first side flap has a tapered edge and the second side flap has a tapered edge.

9. Apparatus of claim 2 wherein the end flap has a leading edge and an elastic band proximal to the leading edge.

10. Apparatus of claim 9 wherein the leading edge has a length greater than a length of an edge opposite to the leading edge.

11. Apparatus for retaining bedding articles of a bed, the bed including an upper structural member having first and second upper side walls and an upper end wall and including a lower structural member having first and second lower side walls and a lower end wall, the apparatus comprising:

a base adapted to be disposed between the upper and lower structural members;

a skirt extending from the base;

a plurality of base fasteners attached to the skirt and adapted to removably engage with a plurality of corresponding bedding fasteners attached to a bedding article;

first and second side flaps secured to the base, each flap having a side fastener, wherein the first side flap is adapted to circumscribe a portion of the first upper side wall and the second flap is adapted to circumscribe a portion of the second upper side wall; and, an end flap secured to the first and second side flaps and having an end fastener, the end flap adapted to circumscribe a portion of the upper end wall, wherein the side fasteners of the first and second side flaps are adapted to removably engage with the end fastener at a location adjacent a horizontal surface of the upper structural member.

12. Apparatus of claim 11 further comprising a plurality of tabs each attached to sites on the skirt, wherein an end of each tab is free to displace angularly with respect to the attachment site of the tab.

13. Apparatus of claim 12 wherein each base fastener is secured to a corresponding one of the tabs.

14. Apparatus of claim 11 wherein each bedding fastener includes a base element having a base element area and a fastening element having a fastening element area less than the base element area, wherein the fastening element is centrally disposed on the base element.

15. Apparatus of claim 11 wherein the skirt includes a first side panel adapted to be disposed adjacent to the first lower side wall, a second side panel adapted to be disposed adjacent to the second lower side wall, and an end panel adapted to be disposed adjacent to the lower end wall.

16. Apparatus of claim 11 wherein the end flap is secured to the base and the first and second side flaps are secured to the base by means of the end flap.

* * * * *